US005605254A

United States Patent [19]

Wagner, III et al.

[11] Patent Number: 5,605,254

[45] Date of Patent: Feb. 25, 1997

[54] VENTILATED DIRECTIONAL DISPENSING CAP

[75] Inventors: George J. Wagner, III, 2436 Eagles Eyrie Ct. #6, Louisville, Ky. 40206; Gerald Cox, Louisville, Ky.

[73] Assignee: George J. Wagner, III, Louisville, Ky.

[21] Appl. No.: 396,675

[22] Filed: Mar. 1, 1995

[51] Int. Cl.[6] ..... B67D 1/16

[52] U.S. Cl. ..... 222/108; 222/153.05; 222/479; 222/481.5; 222/485

[58] Field of Search ..... 222/108, 153.05, 222/479, 481.5, 484, 485, 571

[56] References Cited

U.S. PATENT DOCUMENTS

| | | | |
|---|---|---|---|
| D. 274,696 | 7/1984 | Marsden | D9/352 |
| 2,447,870 | 8/1948 | Polcyn | 65/13 |
| 2,812,120 | 11/1957 | Beall, Jr. | 222/481.5 |
| 3,059,816 | 10/1962 | Goldstein | 222/109 |
| 3,369,718 | 2/1968 | Libit et al. | 222/481.5 |
| 3,419,198 | 12/1968 | Pettersen | 222/541 |
| 3,655,102 | 4/1972 | Moran | 222/484 |
| 4,078,700 | 3/1978 | Hidding | 222/571 X |
| 4,193,519 | 3/1980 | Dubach et al. | 222/484 X |
| 4,241,855 | 12/1980 | Yoshioka | 222/481.5 X |
| 4,452,381 | 6/1984 | Freeman | 222/465 |
| 4,741,459 | 5/1988 | Silvenis et al. | 222/571 X |
| 4,779,766 | 10/1988 | Kinsley | 222/153 |
| 4,782,985 | 11/1988 | Kinsley | 222/481.5 |
| 4,815,663 | 3/1989 | Tada | 222/383.1 X |
| 4,877,159 | 10/1989 | Strand | 222/484 |
| 4,958,754 | 9/1990 | Dennis | 222/383.1 |
| 5,072,861 | 12/1991 | Joe | 222/481 |

FOREIGN PATENT DOCUMENTS

| | | | |
|---|---|---|---|
| 2480245 | 10/1981 | France | 222/153.05 |

*Primary Examiner*—Joseph Kaufman

*Attorney, Agent, or Firm*—Wheat, Camoriano, Smith & Beres, PLC

[57] ABSTRACT

A threaded, closeable cap is provided for a bottle. A removable seal can be located between the cap and the bottle. The cap provides directional flow, an aeration tube, elimination of slippage when pouring, and elimination of drips.

10 Claims, 2 Drawing Sheets

VENTILATED DIRECTIONAL DISPENSING CAP

BACKGROUND OF THE INVENTION

The present invention relates to caps for vessels.

Many different types of caps are known for vessels. For example, there is a conventional bottle cap which is pried loose to open the bottle and is then thrown away, leaving the bottle open. There are flip top caps. There are screw-on caps. There are even special dispensing bottles and caps which are sold separately from the product.

It is often desirable to have an inner seal on a vessel when the product is sold in addition to the cap. The inner seal is usually a piece of paper, plastic or metal which lies over the top of the vessel and is enclosed by the cap. These inner seals prevent leakage of the product during shipping and maintain product freshness until the customer opens the product and breaks the inner seal.

It is also known that the use of an elongated air vent tube is advantageous when pouring a liquid from a vessel, in that it allows air to enter the vessel to replace the liquid that is leaving the vessel, thereby providing a smoothly-flowing dispensing action. However, in order to provide an elongated air vent tube, the tube typically extends down into the vessel, which precludes the use of an inner seal as described above.

There is a beverage-dispensing system, shown in U.S. Pat. No. 4,452,381 "Freeman", in which a vessel is sold separately from the liquid product. This vessel is made in four parts. The base of the vessel is a jar with a threaded top. In order to close off the jar, a standard jar lid is used. When the vessel is in use, the jar lid is removed, an elongated neck is threaded onto the jar, and a vented, directional dispensing cap is snapped onto the top of the elongated neck. This is an expensive system, because it includes several parts and because it is purchased in addition to the vessel in which the product is sold. This is also a cumbersome system to use, because, after the dispenser is used, the neck and cap must be removed and washed, and the separate jar lid must be put onto the jar in order to close the jar for storage. Then, the jar can be refrigerated if necessary, so the product inside does not spoil. Despite the difficulties, this product is very popular and is a standard dispenser in bars and restaurants.

SUMMARY OF THE INVENTION

The present invention provides a much simpler and more practical beverage dispensing system than the prior art.

The present invention provides an aerated dispenser which can be sold in the form in which it is used—not requiring a separate lid or a separate neck for shipping and another for use.

The present invention provides a directional, aerated dispenser which includes an integral closure.

The present invention provides a dispensing system which is easy to grasp and pour, and which is easy to open and close.

DESCRIPTION OF THE PREFERRED EMBODIMENT

Figure 1:
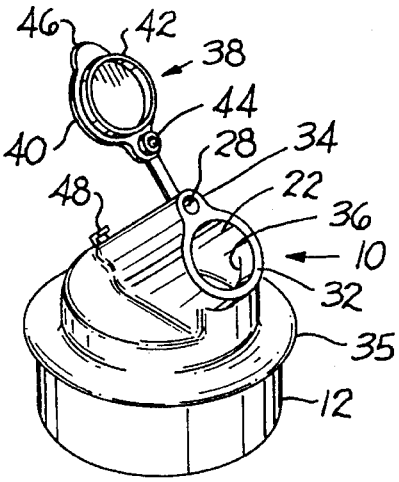
FIG. 1 is a perspective view of an open cap made in accordance with he present invention.

The dispensing cap 10 as shown in FIGS. 1–10 includes several parts. The cap 10 includes a substantially cylindrical base 12 which has internal threads 14 in its lower portion. This base 12 has a substantially vertical axis 16. The base 12 also defines an annular ledge 18 on its inner surface above the threads 14 for sealing against the top of the vessel 20.

The cap 10 also includes a dispensing tube 22 which is in fluid communication with the base 12. The dispensing tube 22 has an axis 24 which lies at an angle to the axis 16 of the base 12. The lower termination point 26 of the dispensing tube 24 lies above the annular ledge 18 of the base 12. The cap 10 includes an air tube 28, which lies parallel to the dispensing tube 22 and which also has a lower termination point 30 lying above the annular ledge 18 of the base 12. It is important that the lower termination points of the tubes 22, 28 lie above the ledge 18 so they do not interfere with the seal 50, which is described below. The upper termination points 32, 34 of the dispensing tube 22 and air tube 28, respectively, are coplanar, which makes them easy to close off with a flat closure. The lower termination points are at a lower elevation than the upper termination points.

Figure 9:
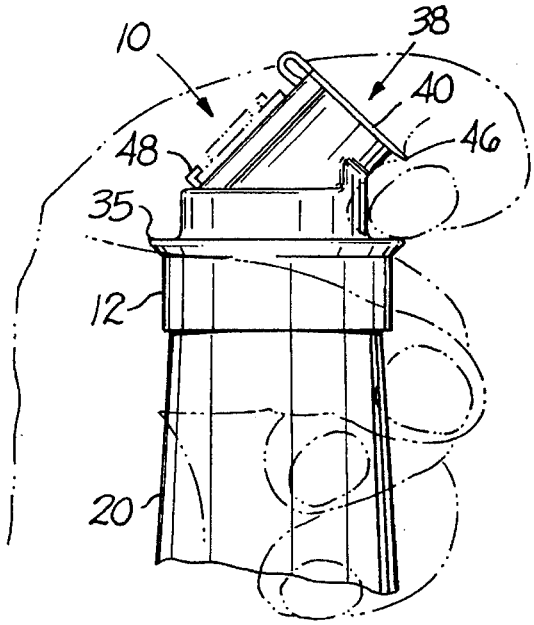
FIG. 9 is an enlarged, broken-away view of the bottle of FIG. 8, showing a person's hand in phantom holding the bottle and opening the cap.

There is an annular flange 35 on the outside of the cap 10, which provides a stopping point, so a person's hand will not slip off the top of the vessel when holding the vessel, as shown in FIG. 9.

There is also a sharp arc 36 on the inside surface of the dispensing tube 22, near the upper termination point 32. This sharp arc 36 provides a surface to which liquid can adhere, and the surface tension of liquid adhering to the sharp arc 36 tends to prevent drips as a person stops pouring the liquid.

Figure 2:
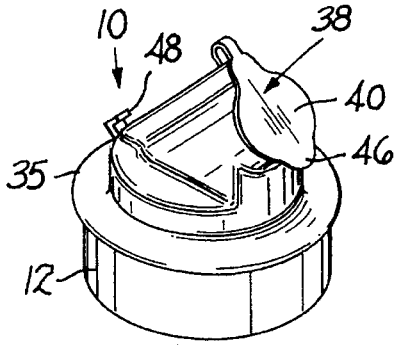
FIG. 2 is a perspective view of the cap of FIG. 1 in the closed positions.
Figure 3:
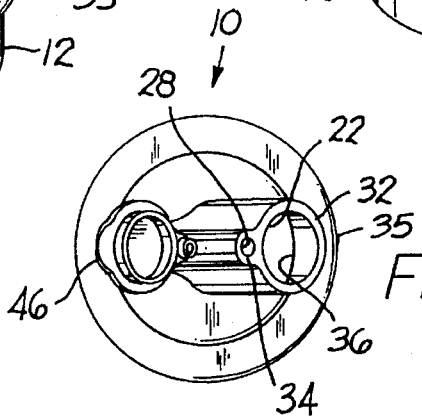
FIG. 3 is a top view of the cap of FIG. 1.
Figure 4:
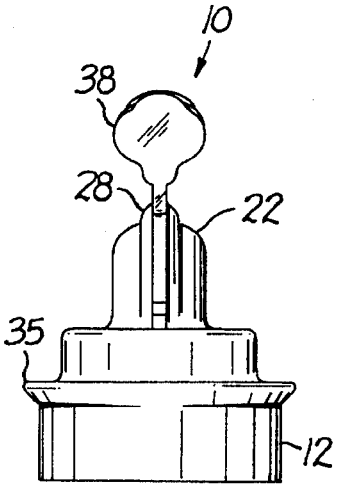
FIG. 4 is a rear view of the cap of FIG. 1.
Figure 5:
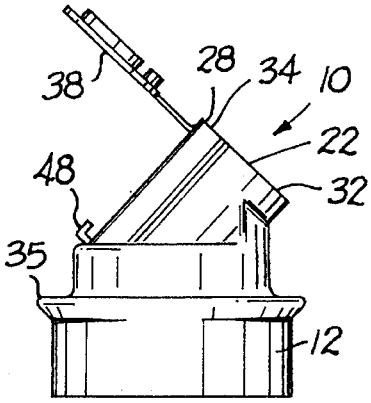
FIG. 5 is a side view of the cap of FIG. 1.
Figure 6:
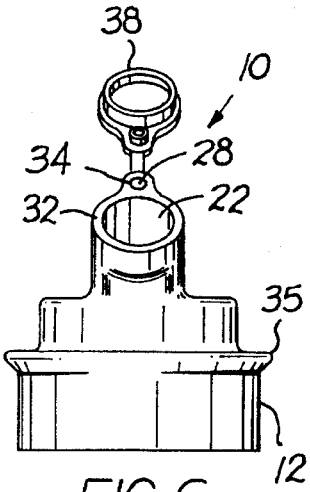
FIG. 6 is a front view of the cap of FIG. 1.
Figure 7:
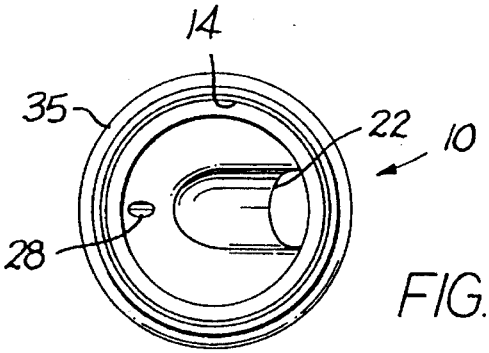
FIG. 7 is a bottom view of the cap of FIG. 1.
Figure 8:
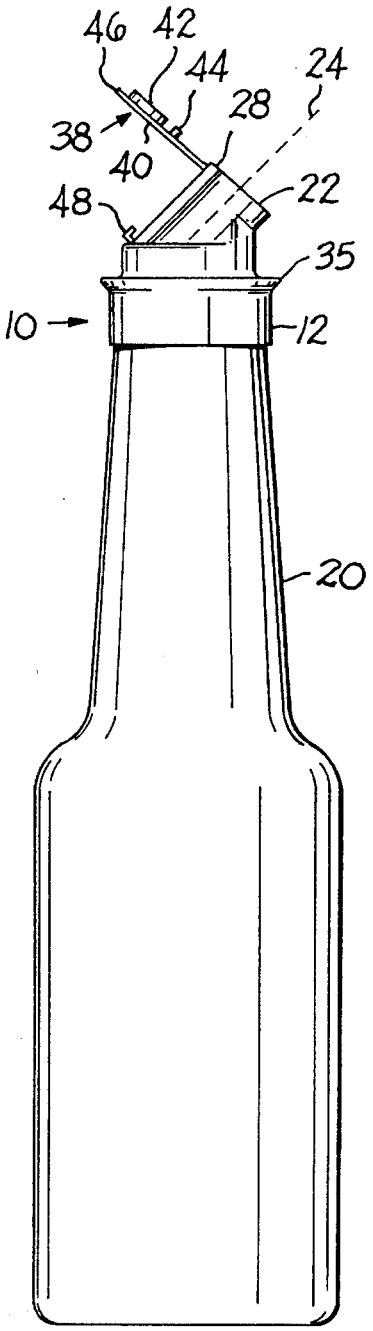
FIG. 8 is a side view of a bottle with the cap of FIG. 1 mounted on it.

The cap 10 also includes a closure 38, which is preferably molded as an integral part of the cap 10. The closure 38 projects from the cap 10 and can flex relative to the base portion 12, so that it can move from a closed position, as shown in FIGS. 2 and 9 to an open position, as shown in the other figures. The closure 38 includes a solid, flat top 40 and two annular projections 42, 44, extending from the top 40. The larger projection 42 is sized to fit into the top end of the dispensing tube 22, and the smaller projection 44 is sized to fit into the top end of the air tube 28, so that, when the closure 38 is in the closed position, the projections 42, 44 fit into their respective openings 22, 28. The flat top 40 extends beyond the projections 42, 44, to form a tab 46, which can be used to open the closure 38, as shown in FIG. 9.

There is also a hook 48, which projects outwardly from the cap 10 and which is preferably also an integral, molded part of the cap. The hook 48 receives the tab 46 to hold the closure 38 in the open position, as shown in phantom in FIG. 9.

Figure 10:
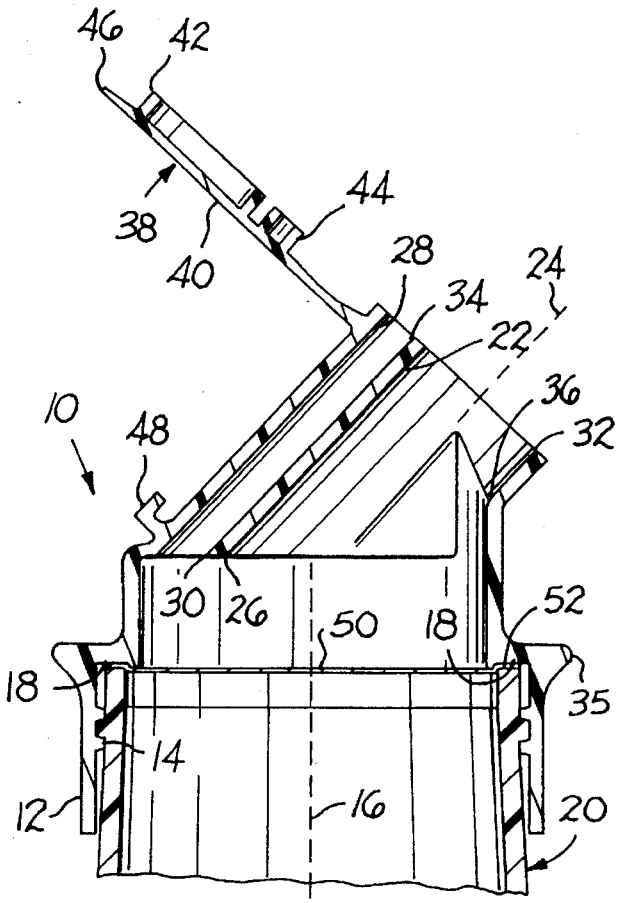
FIG. 10 is a broken-away side sectional view of the bottle of FIG. 8.

FIG. 10 shows the cap 10 on a vessel 20, as it would be sold to the consumer. A removable seal 50 is located at the top of the vessel 20, between the top edge 52 of the bottle 20 and the annular ledge 18 of the cap 10, and the removable seal 50 extends across the entire top of the bottle 20 to seal it. This type of removable seal 50 is well-known in the art. After the consumer purchases the bottle with the contents in it, the consumer unscrews the cap 10, removes the seal 50, and replaces the cap 10. Thereafter, the cap 10 stays on the bottle 20. To dispense the product, the closure 38 is opened, and the bottle 20 is tilted at an angle until product leaves the bottle 20 through the dispensing tube 22. When the bottle is moved from the tilted position toward a vertical position, the sharp arc 36 on the interior surface of the cap 10 helps cut off the flow of liquid, helping to eliminate drips. Once the bottle 20 is in the upright position, the closure 38 is closed over the two openings 22, 28, and the bottle can then be refrigerated, if necessary.

This bottle and cap combination can provide a function that nothing in the prior art can provide. It provides a bottle with a closeable, threaded cap which provides smooth pouring, due to the air tube, which prevents drips, due to the sharp arc on its inner surface, which prevents slippage, due to the flange stop on its outer surface, and which can be sold with a removable seal in place without requiring a separate cap for shipping purposes. The bottle can be opened and closed using only one finger.

It will be obvious to those skilled in the art that modifications may be made to the embodiment of the invention described above without departing from the scope of the present invention.

What is claimed is:

1. A one-piece dispensing cap, comprising:

a substantially cylindrical base, defining internal threads in its lower portion, and having a substantially vertical axis, and defining an annular ledge on its inner surface above said threads for sealing against the vessel;

a dispensing tube in fluid communication with said base and having an axis which lies at an angle to the axis of the base; said dispensing tube having a lower termination point which lies above said annular ledge; and an elongated air tube in fluid communication with said base and having a lower termination point which lies above said annular ledge, wherein said dispensing tube and said air tube lie substantially parallel to each other and define upper termination points which are coplanar, with said dispensing tube and said air tube being entirely separate from each other at their upper termination points.

2. A one-piece dispensing cap, comprising:

a substantially cylindrical base, defining internal threads in its lower portion, and having a substantially vertical axis, and defining an annular ledge on its inner surface above said threads for sealing against the vessel;

a dispensing tube in fluid communication with said base and having an axis which lies at an angle to the axis of the base; said dispensing tube having a lower termination point which lies above said annular ledge; and an elongated air tube in fluid communication with said base and having a lower termination point which lies above said annular ledge, said one-piece cap further comprising a closure, which projects from said cap, said closure including first and second projections which fit into said air tube and said dispensing tube, respectively; said closure also being able to flex relative to said base portion and having a closed position, in which it closes off said dispensing tube and said air tube, and an open position, in which said dispensing tube and air tube are open.

3. A one-piece dispensing cap as recited in claim 2, wherein said closure extends beyond said dispensing tube when in the closed position, thereby providing a tab to be used for opening the closure.

4. A one-piece dispensing cap as recited in claim 3, wherein said base includes a hook-shaped projection, which serves as a catch such that, when the tab of the closure is contacting the hook-shaped projection, it is held in the open position by the hook-shaped projection.

5. A cap and bottle combination, comprising:

a bottle having an elongated neck defining a substantially vertical axis; said neck defining threads at its upper end and terminating at a top edge;

a one-piece dispensing cap having a base with internal threads in its bottom portion which are threaded onto the threads on the bottle neck; said dispensing cap including an annular projection on its inside surface which abuts the top edge of said bottle neck;

a circular seal on the top edge of said bottle neck, lying between said bottle neck and the annular projection on the inside surface of the cap, so that liquid cannot be dispensed from the bottle without removing said seal;

a directional dispensing tube which is a unitary part of said cap, said dispensing tube having an axis which lies at an angle to the axis of the bottle neck, said dispensing tube having a bottom termination point which lies above said seal; and an elongated air tube which is a unitary part of said cap, said air tube having a bottom termination point which lies above said seal.

6. A cap and bottle combination as recited in claim 5, wherein said cap further comprises a closure, projecting from said cap and flexible relative to said base; said closure being movable from a closed position, in which it closes said dispensing tube and said elongated air tube, and an open position, in which it opens said dispensing tube and said elongated air tube.

7. A cap and bottle combination as recited in claim 6, wherein the portions of said dispensing tube and said air tube which are closed by said closure are coplanar, so that all the closing is done on a single plane.

8. A one-piece dispensing cap comprising:

a substantially cylindrical base, defining internal threads in its lower portion and having a substantially vertical axis, and defining an annular ledge on its inner surface above said threads or sealing against the vessel;

a dispensing tube in fluid communication with said base and having an axis which lies at an angle to the axis of the base; said dispensing tube having a lower termination point which lies above said annular ledge; and an elongated air tube in fluid communication with said base and having a lower termination point which lies above said annular ledge, wherein said dispensing tube and said air tube each have an upper termination point, and said lower termination points lie at a lower elevation than said respective upper termination points.

9. A one-piece dispensing cap as recited in claim 8, wherein said base also defines an annular projection on its outer surface which serves as a stop, to reduce the possibility for slippage when the vessel is held in a person's hand for pouring.

10. A one-piece dispensing cap as recited in claim 8, and further comprising an internal ridge in said dispensing tube, which gives the liquid something to adhere to so as to help prevent drips.

* * * * *